US008059054B2

(12) United States Patent
Mohammadian et al.

(10) Patent No.: US 8,059,054 B2
(45) **Date of Patent: *Nov. 15, 2011**

(54) COMPACT ANTENNAS FOR ULTRA WIDE BAND APPLICATIONS

(75) Inventors: Alireza Hormoz Mohammadian, San Diego, CA (US); Joseph Patrick Burke, Carlsbad, CA (US); Samir S Soliman, San Diego, CA (US)

(73) Assignee: QUALCOMM, Incorporated, San Diego, CA (US)

( * ) Notice: Subject to any disclaimer, the term of this patent is extended or adjusted under 35 U.S.C. 154(b) by 617 days.

This patent is subject to a terminal disclaimer.

(21) Appl. No.: 11/615,802

(22) Filed: Dec. 22, 2006

(65) Prior Publication Data

US 2008/0150823 A1 Jun. 26, 2008

Related U.S. Application Data

(63) Continuation of application No. 10/999,745, filed on Nov. 29, 2004, now Pat. No. 7,158,089.

(51) Int. Cl.
*H01Q 9/28* (2006.01)
*H01Q 1/38* (2006.01)

(52) U.S. Cl. ..... 343/795; 343/700 MS

(58) Field of Classification Search ..... 343/700 MS, 343/793, 795

See application file for complete search history.

(56) References Cited

U.S. PATENT DOCUMENTS

| | | | |
|---|---|---|---|
| 3,836,976 | A | 9/1974 | Monser et al. |
| 3,887,925 | A | 6/1975 | Ranghelli et al. |
| 3,947,850 | A | 3/1976 | Kaloi |
| 4,083,046 | A | 4/1978 | Kaloi |
| 4,287,518 | A | 9/1981 | Frosch et al. |
| 4,816,836 | A | 3/1989 | Lalezari |
| 4,843,403 | A | 6/1989 | Lalezari et al. |
| 4,980,693 | A | 12/1990 | Wong et al. |
| 5,005,019 | A | 4/1991 | Zaghloul et al. |
| 5,287,116 | A | 2/1994 | Iwasaki et al. |
| 5,319,377 | A | 6/1994 | Thomas et al. |
| 5,598,174 | A | 1/1997 | Erkocevic et al. |
| 5,754,145 | A | 5/1998 | Evans |
| 5,872,546 | A | 2/1999 | Ihara et al. |
| 5,898,405 | A | 4/1999 | Iwasaki |
| 5,949,383 | A | 9/1999 | Hayes et al. |
| 6,037,911 | A | 3/2000 | Brankovic et al. |
| 6,091,373 | A | 7/2000 | Raguenet |

(Continued)

FOREIGN PATENT DOCUMENTS

| | | | |
|---|---|---|---|
| CN | 1503402 | A | 6/2004 |

(Continued)

OTHER PUBLICATIONS

"International Search Report and Written Opinion—PCT/US05/043187, International Search Authority—European Patent Office—Apr. 26, 2006".

(Continued)

*Primary Examiner* — Shih-Chao Chen

(74) *Attorney, Agent, or Firm* — Ramin Mobarhan

(57) ABSTRACT

Compact antennas for ultra wide band applications are disclosed. The compact antenna may be an elliptic dipole antenna with a poise and counterpoise both having an elliptical shape. A substrate may be used to support the poise and counterpoise with the substrate having a closed three-dimensional shape.

40 Claims, 6 Drawing Sheets

U.S. PATENT DOCUMENTS

| | | | | |
|---|---|---|---|---|
| 6,094,179 | A * | 7/2000 | Davidson | 343/895 |
| 6,191,740 | B1 | 2/2001 | Kates et al. | |
| 6,222,494 | B1 | 4/2001 | Erkocevic | |
| 6,337,666 | B1 | 1/2002 | Bishop | |
| 6,339,405 | B1 | 1/2002 | Gleener | |
| 6,400,332 | B1 | 6/2002 | Tsai et al. | |
| 6,512,488 | B2 | 1/2003 | Schantz | |
| 6,559,809 | B1 | 5/2003 | Mohammadian et al. | |
| 6,642,903 | B2 | 11/2003 | Schantz | |
| 6,768,461 | B2 * | 7/2004 | Huebner et al. | 343/700 MS |
| 6,774,850 | B2 | 8/2004 | Chen | |
| 7,123,207 | B2 | 10/2006 | Yazdandoost et al. | |
| 7,158,089 | B2 * | 1/2007 | Mohammadian et al. | 343/795 |
| 7,183,977 | B2 * | 2/2007 | Suh | 343/700 MS |
| 7,202,819 | B2 * | 4/2007 | Hatch | 343/700 MS |
| 7,209,089 | B2 | 4/2007 | Schantz | |
| 7,365,698 | B2 * | 4/2008 | Dwyer et al. | 343/792 |
| 7,589,676 | B2 | 9/2009 | Popugaev et al. | |
| 2003/0201942 | A1 | 10/2003 | Poilasne et al. | |
| 2004/0036655 | A1 | 2/2004 | Sainati et al. | |
| 2004/0100406 | A1 | 5/2004 | Okado | |
| 2004/0217903 | A1 | 11/2004 | Aisenbrey | |
| 2004/0217912 | A1 | 11/2004 | Mohammadian | |
| 2005/0110687 | A1 | 5/2005 | Starkie et al. | |
| 2005/0259013 | A1 | 11/2005 | Gala Gala et al. | |

FOREIGN PATENT DOCUMENTS

| | | |
|---|---|---|
| EP | 0301216 A2 | 2/1989 |
| EP | 0766343 | 4/1997 |
| GB | 2359664 | 8/2001 |
| WO | WO9741695 A2 | 11/1997 |

OTHER PUBLICATIONS

Nilavalan et al., "Wideband Printed Bow Tie Antenna Element Development for Post Reception Synthetic Focusing Surface Penetrating Radar," Electronics Letters, IEE Stevenage vol. 35, No. 20, Sep. 30, 1999, pp. 1771-1772.

European Search Report—EP10150756, Search Authority—Munich Patent Office, Mar. 24, 2010.

* cited by examiner

FIG. 1
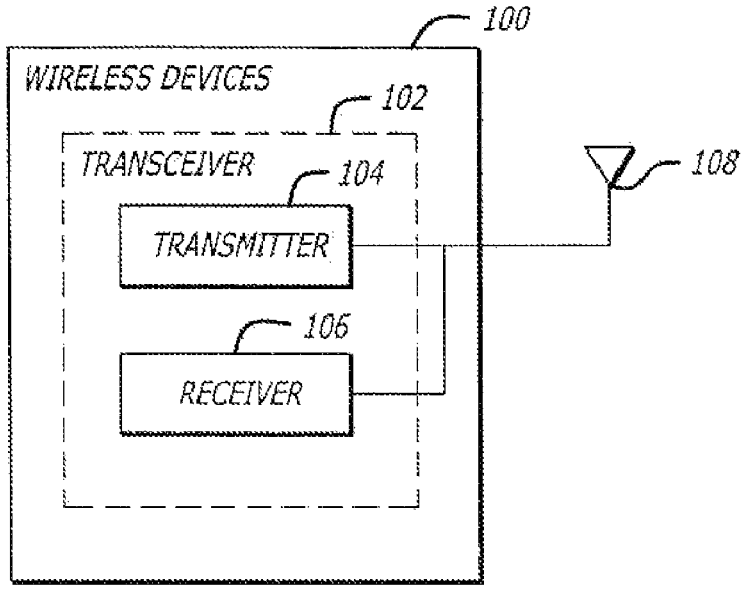
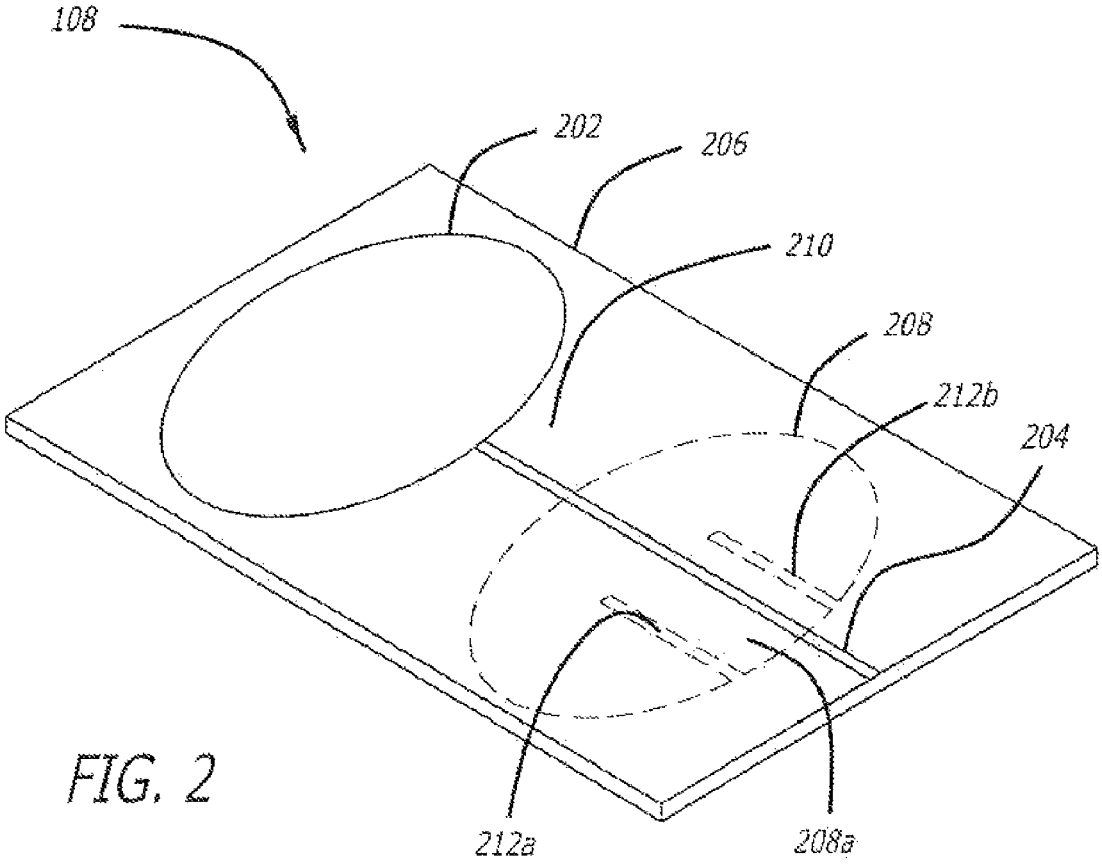
FIG. 2

FIG. 10A
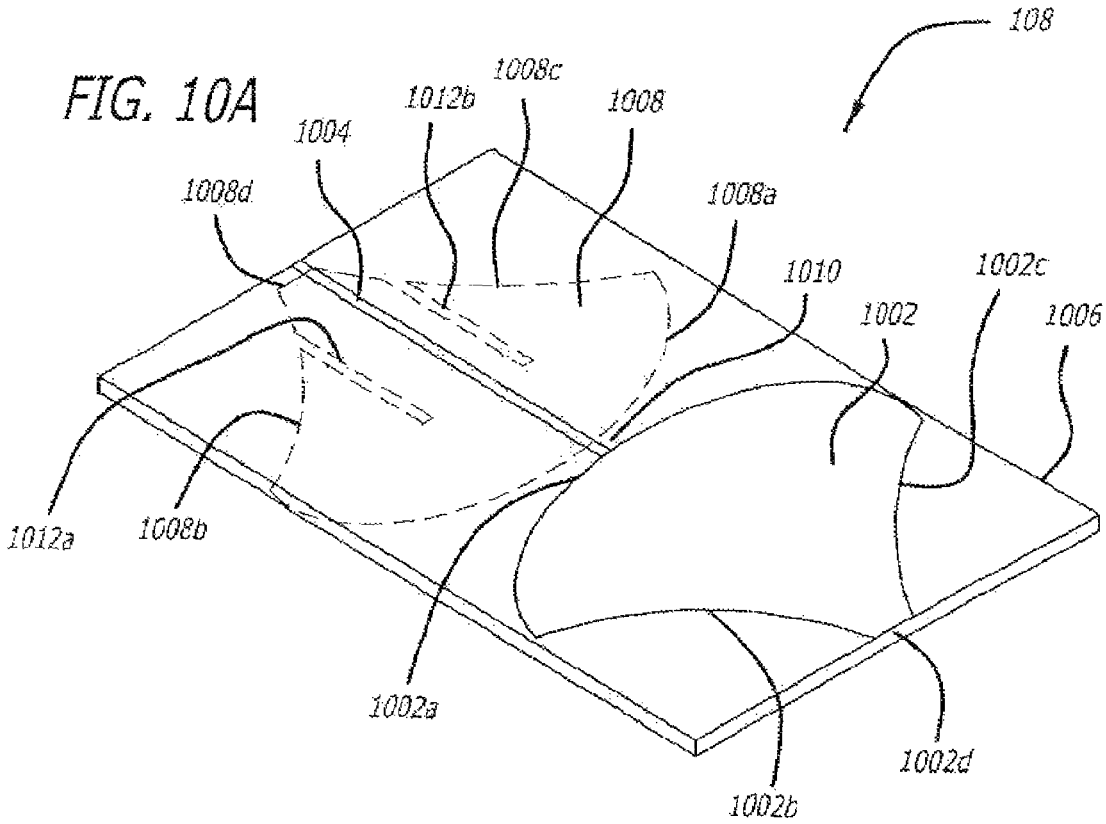
FIG. 10B
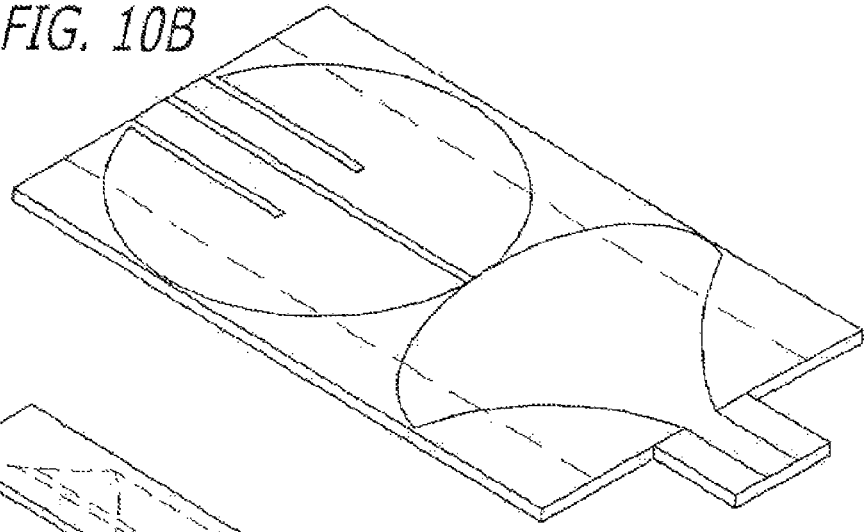
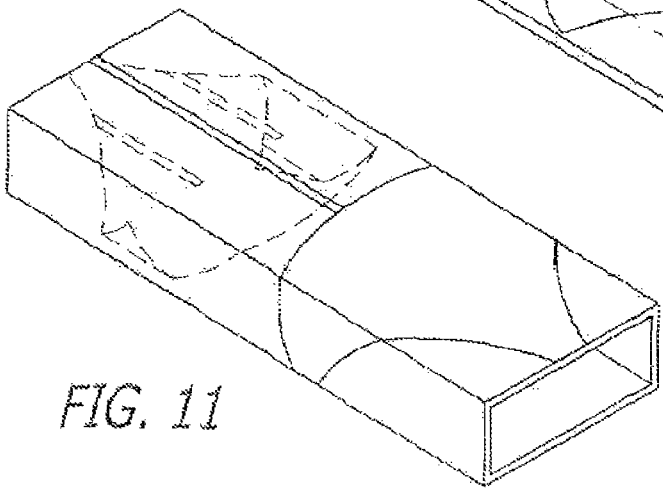
FIG. 11

COMPACT ANTENNAS FOR ULTRA WIDE BAND APPLICATIONS

CLAIM OF PRIORITY UNDER 35 U.S.C. §120

The present Application for Patent is a continuation of patent application Ser. No. 10/999,745 entitled "COMPACT ANTENNAS FOR ULTRA WIDE BAND APPLICATIONS" filed Nov. 29, 2004, now U.S. Pat. No. 7,158,089, and assigned to the assignee hereof and hereby expressly incorporated by reference herein.

BACKGROUND

1. Field

The present disclosure relates generally to antennas, and more specifically, to compact antennas for Ultra Wide Band applications.

2. Background

Portable devices capable of wireless communications are currently available in several different forms, including mobile telephones and personal digital assistants (PDAs). A portable device such as a wireless modem may also be used to provide such capabilities to a laptop or other computer. The technology supporting these devices is expanding rapidly and today includes such features as Internet access, email services, simultaneous transmission of voice and data, and video. Ultra-Wideband (UWB) technology is just one example of emerging technology being developed to support such devices. UWB provides high speed communications over an extremely wide bandwidth. At the same time, UWB signals are transmitted in very short pulses that consume very little power.

UWB antennas need to have an operating frequency band between 3.1 to 10.6 GHz. These antennas typically occupy a larger volume than conventional narrow band antennas. This can pose a problem in most practical applications especially when the antenna is intended for a portable wireless device where the real estate is scarce. The situation may become even worse when there is a need to use diversity combining techniques where at least two antennas need to share the available real estate.

One type of antenna commonly used in high bandwidth applications is the chip antenna. A chip antenna includes a ceramic substrate supporting metallic traces positioned over a ground plane with the ground removed from underneath the chip. One problem with this antenna is that the ground plane tends to increase the overall size of the antenna. Although, the ground plane for the printed circuit board supporting the electronics may be used in some applications, the antenna dictates the size of the plane which is not desirable. Also, induced RF currents on the printed circuit board may cause receiver desensitization, thereby limiting the useful range of the portable wireless device. In diversity applications, there would be increased coupling between the antennas since they share the same ground plane, thereby reducing diversity gain.

Accordingly, there is a need for a high bandwidth compact antenna for portable wireless devices. The high bandwidth compact antenna should be designed in a way that does not significantly degrade the performance of the electronics.

SUMMARY

In one aspect of the present invention, an elliptic dipole antenna includes a poise and counterpoise each having an elliptical shape, and a substrate supporting the poise and counterpoise, the substrate having a closed three-dimensional shape.

In another aspect of the present invention, a wireless device includes a transceiver, and an elliptic dipole antenna. The elliptic dipole antenna includes a poise and counterpoise each having an elliptical shape, and a substrate supporting the poise and counterpoise, the substrate having a closed three-dimensional shape.

It is understood that other embodiments of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF DRAWINGS

Aspects of the present invention are illustrated by way of example, and not by way of limitation, in the accompanying drawings, wherein:

FIG. 1 is a conceptual block diagram illustrating an example of a wireless device employing an elliptic dipole antenna formed around a substrate;

FIG. 2 is a perspective view illustrating an example of a flat elliptic dipole antenna with a microstrip feed and a flexible printed circuit board substrate;

FIG. 10A-10B is a perspective view illustrating an example of a flat elliptic dipole antenna having a partial elliptical poise with a microstrip feed and a flexible printed circuit board substrate; and FIG. 11 is a perspective view illustrating an example of a elliptic dipole antenna having a partial elliptical poise with a microstrip feed formed around a rectangular flexible printed circuit board substrate.

DETAILED DESCRIPTION

Figure 3:
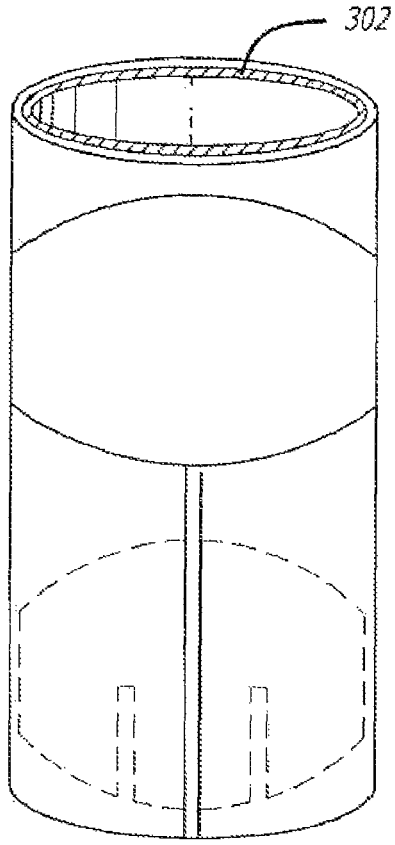
FIG. 3 is a perspective view illustrating an example of a elliptic dipole antenna with a microstrip feed formed around a cylindrical flexible printed circuit board substrate.

The detailed description set forth below in connection with the appended drawings is intended as a description of various embodiments of the present invention and is not intended to represent the only embodiments in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

In one embodiment of the antenna, an elliptic dipole may be formed around a substrate. The substrate may be any closed three-dimensional shape, including by way of example, a cylindrical, rectangular, triangular, spherical, or any other suitable shape. This configuration provides a compact design that can be used on most portable wireless device. In the case of diversity applications, multiple antennas may be arranged on the portable wireless device with adequate spacing to provide sufficient diversity gain. The elliptic dipole antenna provides high bandwidth suitable for UWB applications. It also provides an omni-directional radiation pattern in the azimuth plane as well as a high degree of polarization purity. The elliptic dipole antenna is also a balanced antenna that tends to de-couple the antenna system from the electronics to which it is connected.

FIG. 1 is a conceptual block diagram illustrating an example of a wireless device employing an elliptic dipole antenna formed around a substrate. This elliptic dipole antenna is well suited for portable wireless devices such as mobile telephones, PDAs, laptops, and other computers, but is not limited to such devices. It may be used on any wireless device, especially those wireless devices requiring wide band communications.

The wireless device 100 shown in FIG. 1 may be equipped with a transceiver 102. The transceiver 102 may be a UWB transceiver capable of code division multiple access (CDMA) communications, or any other type of communications. CDMA is a modulation and multiple access scheme based on spread spectrum communications which is well known in the art. The transceiver 102 may include a transmitter 104 and a receiver 106 coupled to an elliptic dipole antenna formed around a substrate 108. The receiver 106 may be used to downconvert a signal from the antenna 108 to baseband, as well as provide spread-spectrum processing, demodulation and decoding of the baseband signal. The transmitter 104 may be used to encode, modulate, and provide spread-spectrum processing of a baseband signal, as well as provide upconversion for the baseband signal to a frequency suitable for over the air transmission through the antenna 108. In alternative embodiments of the wireless device 100, multiple antennas of similar construction may be used to achieve gain due to spatial displacement of the antennas and combining techniques utilized by the receiver 106.

FIG. 2 is a perspective view showing a flat elliptic dipole antenna with a microstrip feed and flexible printed circuit board substrate. The phantom lines are edges hidden from view. The elliptic dipole antenna 108 may include a poise 202 with a microstrip feed 204 on one surface of the substrate 206 and a counterpoise 208 on the other surface of the substrate 206. The poise 202 and counterpoise 208 may have an "elliptical shape" which is defined herein to include not only ellipses, but partial ellipses such as half or quarter ellipses, as well as full or partial circles. The substrate 202 may be a flexible printed circuit board such as DuPont™ Pyralux® AP™ or other suitable polyimide or epoxy-based film. In the embodiment shown, the poise 202 is offset slightly from the counterpoise 208 in the plane of the substrate to form a gap 210. The microstrip feed 204 is used to excite the gap 210, thereby causing the antenna 108 to radiate in the transmit mode. Alternatively, the poise 202 and counterpoise 208 may be excited by an incoming radiated signal in the receive mode. The counterpoise may include a portion 208*a* which provides a ground plane for the microstrip feed 204. Two Isolation gaps 212*a*and 212*b* may be used to separate the ground plane for the microstrip feed 204 from the remainder of the counterpoise 208.

The poise 202, counterpoise 208, and microstrip feed 204 may be formed on the substrate 206 in a variety of fashions. An etching process is just one example. Using an etching process, a conductive layer of material may be laminated, rolled-clad, or otherwise applied to each side of the substrate 206. The conductive material may be copper or other suitable material. The conductive material may then be etched away or otherwise removed from the substrate 206 in predetermined regions to form the poise 202 and microstrip feed 204 on one surface and the counterpoise 208 on the other. Alternatively, the poise 202, counterpoise 208 and microstrip feed 204 may be deposited on the substrate using a metallization process, or any other method providing sufficient metal adhesion for the environmental conditions and the intended use of the antenna. These techniques are well known in the art.

Once the poise 202, counterpoise 208 and microstrip feed 204 are formed onto the substrate 206, regardless of the method, the elliptic dipole antenna 108 may then be formed into a closed three-dimensional shape, such as a cylinder as shown in FIG. 3. The edges of the cylindrical flexible printed circuit board substrate 206 may be bonded together using a suitable adhesive. Increased structural integrity may be achieved by using a cylindrical core 302 to support the substrate 206. A core may be particularly useful to maintain an elliptic dipole antenna 108 that has shapes other than cylindrical, such as the rectangular elliptic dipole antenna shown in FIG. 4. In any event, the core should be a low loss material with a dielectric constant near unity such as ROHACELL® HF or any other suitable plastic material. The core may be solid or hollow. A hollow core tends to reduce the dielectric constant.

Figure 5:
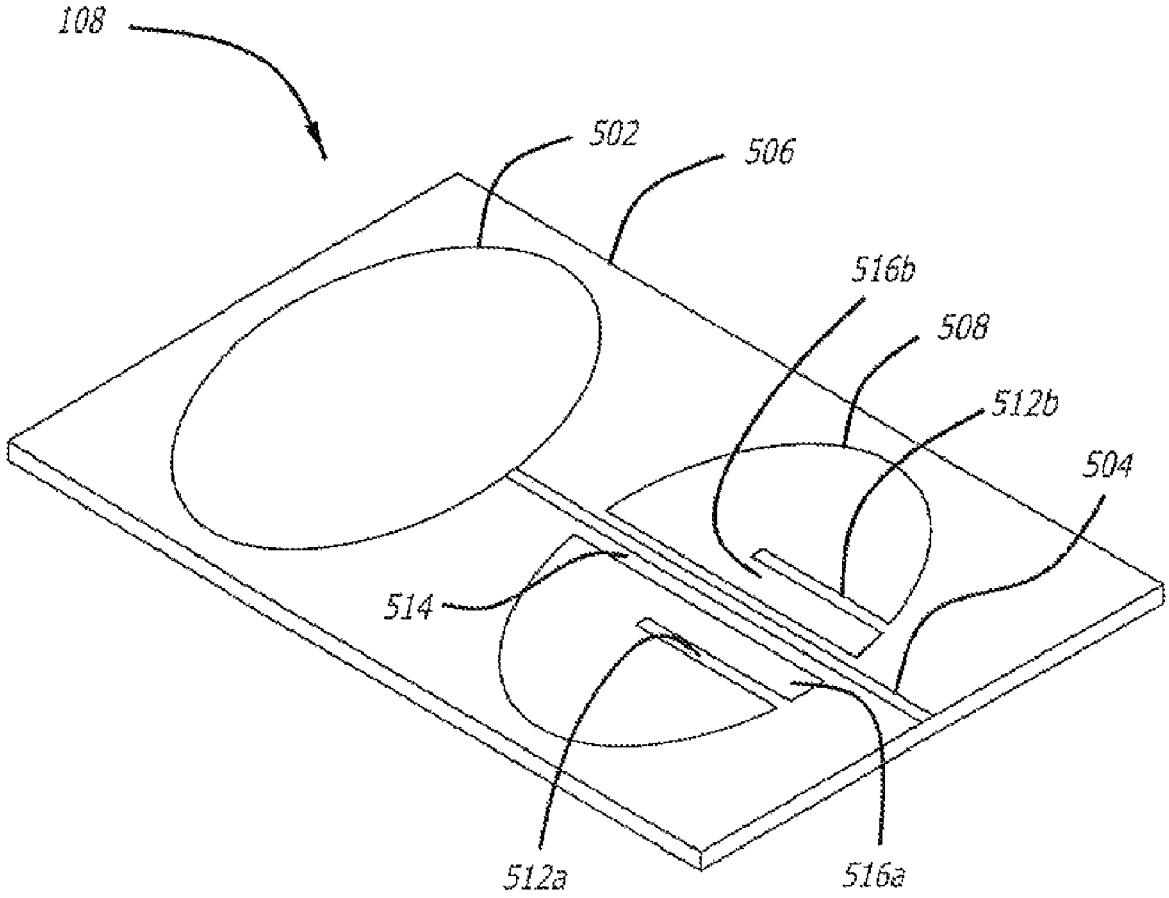
FIG. 5 is a perspective view illustrating an example of a flat elliptic dipole antenna with a coplanar waveguide feed and a flexible printed circuit board substrate.

FIG. 5 is a perspective view illustrating an example of a flat elliptic dipole antenna with a coplanar waveguide feed and a flexible printed circuit board substrate. Unlike the microstrip feed with a ground plane below, a coplanar waveguide feed has a ground plane in the same plane. In this embodiment of the elliptic dipole antenna 108, a poise 502, counterpoise 508, and coplanar waveguide feed 504 is formed on the same surface of the substrate 506 either by etching, metallization, or any other suitable process. The coplanar waveguide feed 504 may extend through a feed gap 514 in the counterpoise 508 to the poise 502. A portion of the counterpoise 516*a* and 516*b* on both sides of the feed gap may be used to provide a ground plane for the coplanar waveguide feed 504. Two isolation gaps 512*a* and 512*b* may be used to separate the ground plane for the coplanar waveguide feed 504 from the remainder of the counterpoise 508.

Figure 4:
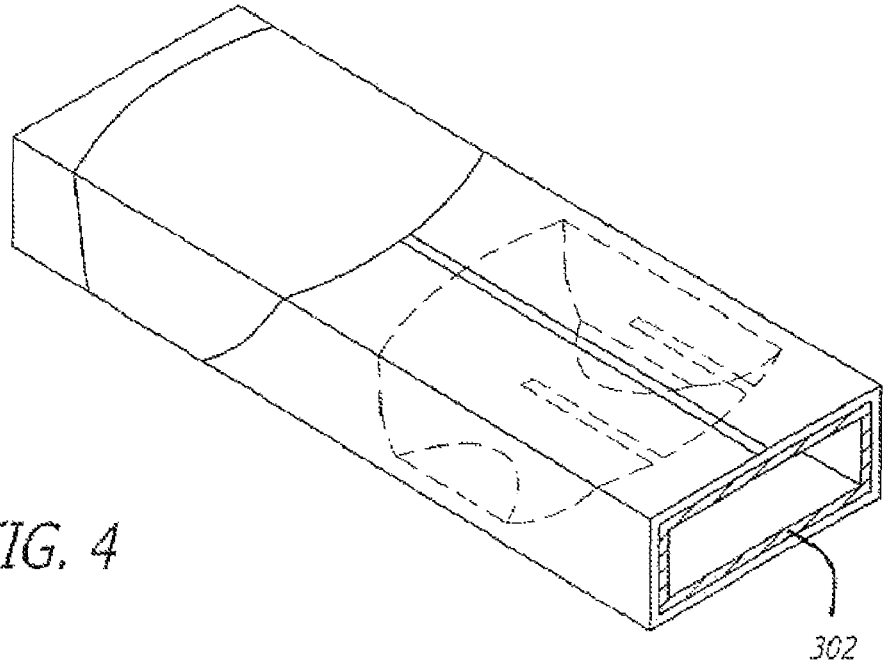
FIG. 4 is a perspective view illustrating an example of an elliptic dipole antenna with a microstrip feed formed around a rectangular flexible printed circuit board substrate.
Figure 6:
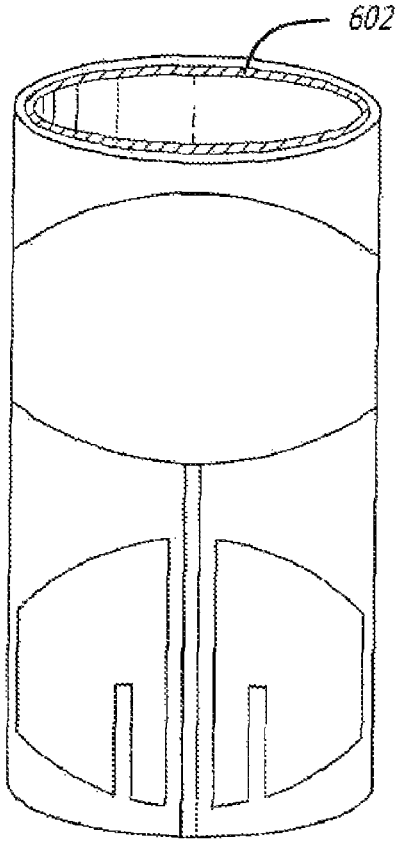
FIG. 6 is a perspective view illustrating an example of an elliptic dipole antenna with a coplanar waveguide feed formed around a cylindrical flexible printed circuit board substrate.
Figure 7:
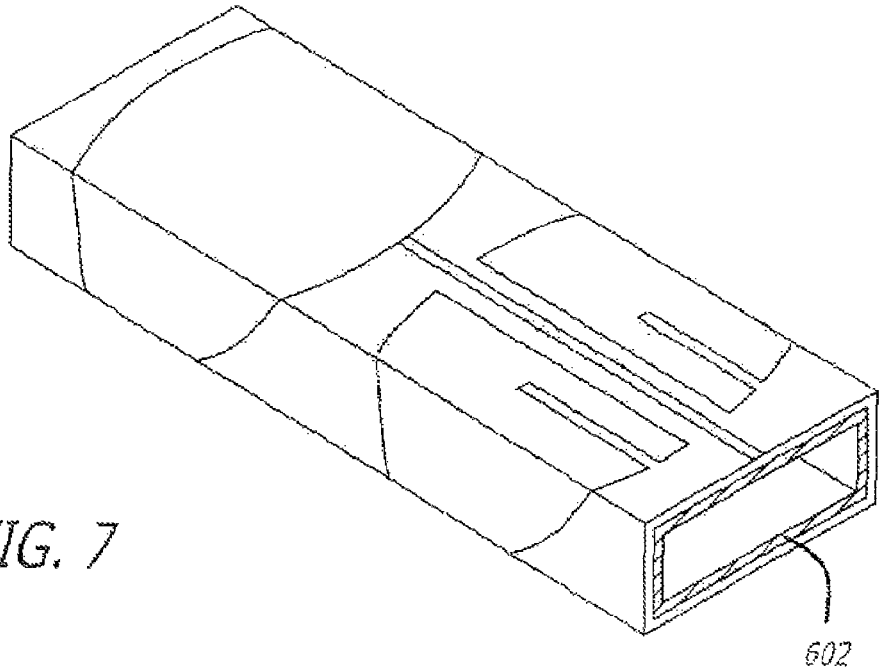
FIG. 7 is a perspective view illustrating an example of an elliptic dipole antenna with a coplanar waveguide feed formed around a rectangular flexible printed circuit board substrate.

The elliptical dipole antenna with its coplanar waveguide feed may be formed into a closed three-dimension shape in the same fashion as the antennas shown in FIGS. 3 and 4. FIG. 6 is a perspective view illustrating an example of an elliptical dipole antenna with a coplanar waveguide feed formed around a cylindrical flexible printed circuit board substrate. The substrate 506 may be supported by a cylindrical core 602 similar to or the same as that described in connection with FIGS. 3 and 4. The cylindrical core 602 may be solid as shown in FIG. 6, or hollow. Alternatively, the elliptical dipole antenna 108 may simply be formed into a cylinder with the edges of the substrate 506 bonded together using a suitable adhesive. As explained earlier, a core may be necessary to maintain an elliptic dipole antenna 108 that has a shape other than cylindrical, such as the rectangular elliptic dipole antenna with the coplanar waveguide feed shown in FIG. 7.

Figure 8:
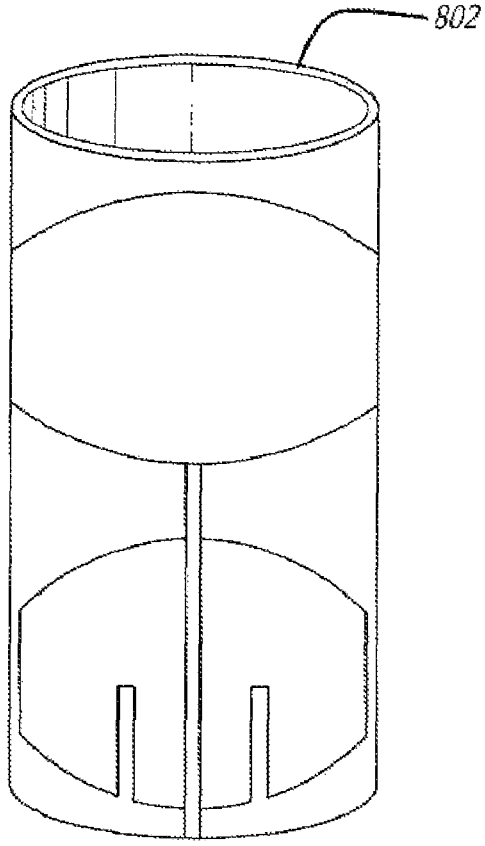
FIG. 8 is a perspective view illustrating an example of an elliptic dipole antenna with a coplanar waveguide feed formed around a cylindrical plastic carrier.
Figure 9:
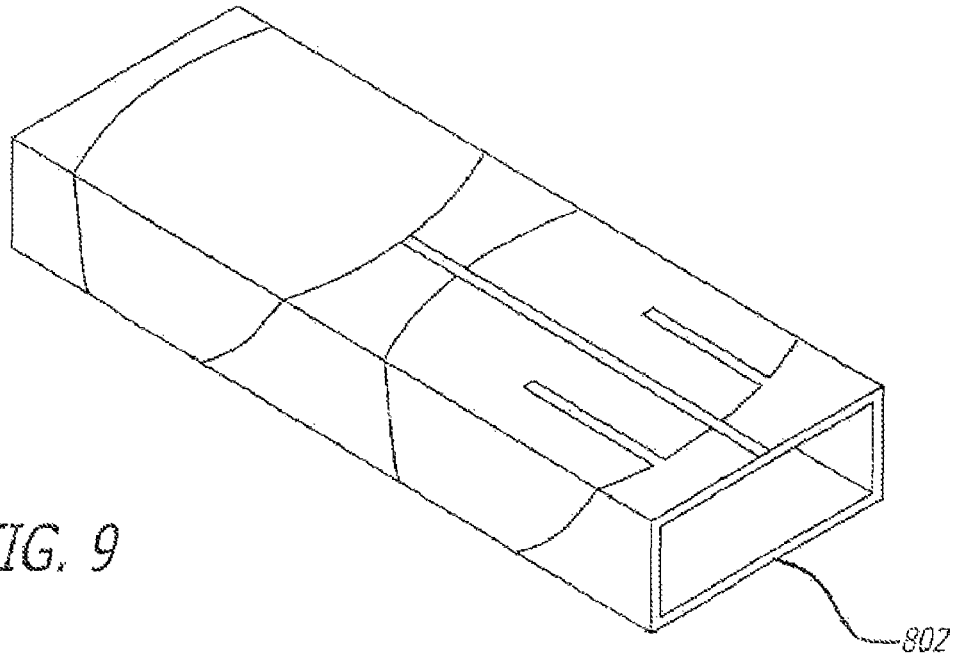
FIG. 9 is a perspective view illustrating an example of an elliptic dipole antenna with a coplanar waveguide feed formed around a rectangular plastic carrier.

As an alternative to a flexible printed circuit board substrate, the poise 502, counterpoise 508, and coplanar waveguide feed 504 may be deposited on a plastic carrier using a metallization process. FIG. 8 is a perspective view illustrating an example of an elliptic dipole antenna with a coplanar waveguide feed formed around a plastic carrier. The plastic carrier 802 may be cylindrical as shown in FIG. 8, or rectangular as shown in FIG. 9. A hollow carrier may be preferred to reduce the dielectric constant, but a solid plastic carrier may also be used.

A further reduction in size of the elliptic dipole antenna 108 may be achieved by modifying the poise and counterpoise and then forming the antenna into a closed three-dimensional shape. More specifically, the poise and counterpoise may be formed as partial ellipses. FIG. 10A-10B is a perspective view illustrating an example of a flat elliptic dipole antenna having a partial elliptical poise with a microstrip feed and a flexible printed circuit board substrate. The phantom lines are edges hidden from view.

The elliptic dipole antenna 108 may include a half elliptical poise 1002 disposed on one side of the flexible printed circuit board substrate 1006. A microstrip feed 1004 may be coupled to the elliptical side of the poise 1002*a*. The opposite side of the poise may include two edges 1002*b* and 1002*c* having an inward taper that extends from the half ellipse portion of the poise and terminates into a tip 1002*d* at the distal end.

The elliptical dipole antenna 108 may also include a half elliptical counterpoise 1008 disposed on the side of the flexible printed circuit board substrate 1006 opposite the poise 1002. The counterpoise is shown with an elliptical side 1008*a* which is offset slightly from the elliptical side of the poise 1002*a*, in the plane of the substrate, to form a gap 1010 that can be excited by the microstrip feed 1004 in the transmit mode. Much like the poise 1002, the counterpoise also includes two edges 1008*b* and 1008*c* having an inward taper that extends from the half ellipse portion of the counterpoise to a straight edge 1008*d* at its distal end. Alternatively, the side of the counterpoise opposite the gap 1012 may be a straight edge or any other suitable edge configuration. Extending from each end of the straight edge 1008*d* is an isolation gap 1012*a* and 1012*b*. The isolation gaps 1012*a* and 1012*b* may be used to separate a portion of the counterpoise from a ground plane for the microstrip feed 1004.

FIG. 11 is a perspective view illustrating an example of a elliptic dipole antenna having a partial elliptical poise with a microstrip feed formed around a rectangular flexible printed circuit board substrate. A solid or hollow core (not shown) may also be used, especially when a flexible printed circuit board substrate is used in a non-cylinder antenna configuration. The tip of the poise 1002*d* may be bent over the end of the antenna 108 which further reduces the length of the antenna.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein may reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A elliptic dipole antenna, comprising:

a poise and counterpoise each having an elliptical shape; and a substrate supporting the poise and counterpoise, the substrate having a closed three-dimensional shape formed by bonding at least a first edge and an opposing edge of the substrate.

2. The elliptic dipole antenna of claim 1 wherein each of the poise and counterpoise comprises an ellipse.

3. The elliptic dipole antenna of claim 1 wherein each of the poise and counterpoise comprises a half ellipse.

4. The elliptic dipole antenna of claim 3 wherein the poise further comprises a folded tip.

5. The elliptic dipole antenna of claim 1 wherein the substrate is cylindrical.

6. The elliptic dipole antenna of claim 1 wherein the substrate is rectangular.

7. The elliptic dipole antenna of claim 1 wherein the substrate comprises a flexible printed circuit board.

8. The elliptic dipole antenna of claim 1 wherein the substrate comprises polyimide film.

9. The elliptic dipole antenna of claim 1 wherein the poise and counterpoise are disposed on opposite sides of the substrate.

10. The elliptic dipole antenna of claim 9 further comprising a microstrip feed coupled to the poise.

11. The elliptic dipole antenna of claim 10 wherein the counterpoise includes a portion which provides a ground plane for the microstrip strip feed, and wherein the counterpoise further comprises two isolation gaps to separate said portion from the remainder of the counterpoise.

12. The elliptic dipole antenna of claim 1 further comprising a core supporting the substrate.

13. The elliptic dipole antenna of claim 12 wherein the core comprises foam plastic.

14. The elliptic dipole antenna of claim 13 wherein the foam plastic core comprises polymethacrylimide.

15. The elliptic dipole antenna of claim 12 wherein the core is solid.

16. The elliptic dipole antenna of claim 12 wherein the core is hollow.

17. The elliptic dipole antenna of claim 1 wherein the poise and the counterpoise are disposed onto the outer surface of the substrate.

18. The elliptic dipole antenna of claim 17 further comprising a coplanar waveguide fed coupled to the poise.

19. The elliptic dipole antenna of claim 18 further comprising a feed gap extending through the counterpoise, and wherein the coplanar waveguide feed extends through the feed gap to the poise.

20. The elliptic dipole antenna of claim 19 wherein the counterpoise includes a portion on each side of the feed gap which provides a ground plane for the coplanar waveguide feed, and wherein the counterpoise further comprises two isolation gaps to separate said portions from the remainder of the counterpoise.

21. A wireless device, comprising:

a transceiver; and an elliptic dipole antenna comprising a poise and counterpoise each having an elliptical shape, and a substrate supporting the poise and counterpoise, the substrate having a closed three-dimensional shape formed by bonding at least a first edge and an opposing edge of the substrate.

22. The wireless device of claim 21 wherein each of the poise and counterpoise comprises an ellipse.

23. The wireless device of claim 21 wherein each of the poise and counterpoise comprises a half ellipse.

24. The wireless device of claim 23 wherein the poise further comprises a folded tip.

25. The wireless device of claim 21 wherein the substrate is cylindrical.

26. The wireless device of claim 21 wherein the substrate is rectangular.

27. The wireless device of claim 21 wherein the substrate comprises a flexible printed circuit board.

28. The wireless device of claim 21 wherein the substrate comprises polyimide film.

29. The wireless device of claim 21 wherein the poise and counterpoise are disposed on opposite sides of the substrate.

30. The wireless device of claim 29 wherein the elliptic dipole antenna further comprises a microstrip feed coupled to the poise.

31. The wireless device of claim 30 wherein the counterpoise includes a portion which provides a ground plane for the microstrip feed, and wherein the counterpoise further comprises two isolation gaps to separate said portion from the remainder of the counterpoise.

32. The wireless device of claim 21 where the elliptic dipole antenna further comprises a core supporting the substrate.

33. The wireless device of claim 32 wherein the core comprises plastic.

34. The wireless device of claim 33 wherein the plastic core comprises polymethacrylimide.

35. The wireless device of claim 32 wherein the core is solid.

36. The wireless device of claim 32 wherein the core is hollow.

37. The wireless device of claim 21 wherein the poise and the counterpoise are disposed onto the outer surface of the substrate.

38. The wireless device of claim 37 wherein the elliptic dipole antenna further comprises a coplanar waveguide feed coupled to the poise.

39. The wireless device of claim 38 further comprising a feed gap extending through the counterpoise, and wherein the coplanar waveguide feed extend through the gap to the poise.

40. The wireless device of claim 39 wherein the counterpoise includes a portion on each side of the feed gap which provides a ground plane for the coplanar waveguide feed, and wherein the counterpoise further comprises two isolation gaps to separate said portions from the remainder of the counterpoise.

* * * * *